US009845947B1

(12) United States Patent
Shanahan, III

(10) Patent No.: US 9,845,947 B1
(45) Date of Patent: Dec. 19, 2017

(54) MULTI-DIRECTIONAL UNDERWATER LIGHTING

(71) Applicant: Richard James Shanahan, III, Naples, FL (US)

(72) Inventor: Richard James Shanahan, III, Naples, FL (US)

( * ) Notice: Subject to any disclaimer, the term of this patent is extended or adjusted under 35 U.S.C. 154(b) by 171 days.

(21) Appl. No.: 14/881,308

(22) Filed: Oct. 13, 2015

(51) Int. Cl.

| | |
|---|---|
| ***F21V 31/00*** | (2006.01) |
| ***F21V 29/70*** | (2015.01) |
| ***F21V 3/00*** | (2015.01) |
| *F21W 131/401* | (2006.01) |
| *F21W 131/40* | (2006.01) |

(52) U.S. Cl.
CPC ..... *F21V 31/005* (2013.01); *F21V 3/00* (2013.01); *F21V 29/70* (2015.01); *F21W 2131/40* (2013.01); *F21W 2131/401* (2013.01)

(58) Field of Classification Search
CPC ..... F21V 31/005; F21V 29/70; F21V 3/00; F21W 2131/40; F21W 2131/401
See application file for complete search history.

(56) References Cited

U.S. PATENT DOCUMENTS

2007/0139913 A1* 6/2007 Savage ..... B63B 45/02 362/101
2012/0287603 A1* 11/2012 Forant ..... F21V 17/10 362/89

* cited by examiner

*Primary Examiner* — David V Bruce
(74) *Attorney, Agent, or Firm* — Arthur Jacob

(57) ABSTRACT

Apparatus and method provide underwater lighting to illuminate a site within a body of water in which underwater lighting apparatus is immersed during a lighting cycle. A housing is constructed of a heat-conductive material and LED arrays are affixed to the housing, within a sealed chamber, to conduct heat from the LED arrays to the housing such that heat generated by the LED arrays during the lighting cycle will be conducted directly to the housing and dissipated by the housing to the surrounding body of water. Light provided by the LED arrays is passed through corresponding lens members located for directing light in different directions. At the same time, fouling by marine organisms is resisted.

8 Claims, 4 Drawing Sheets

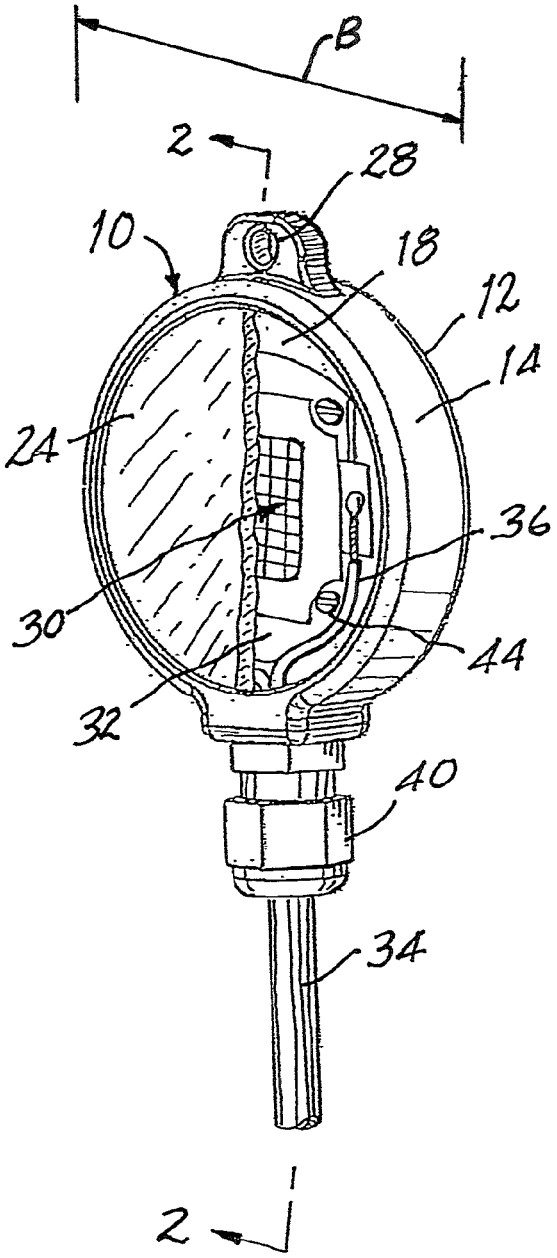
FIG. 1
FIG. 2
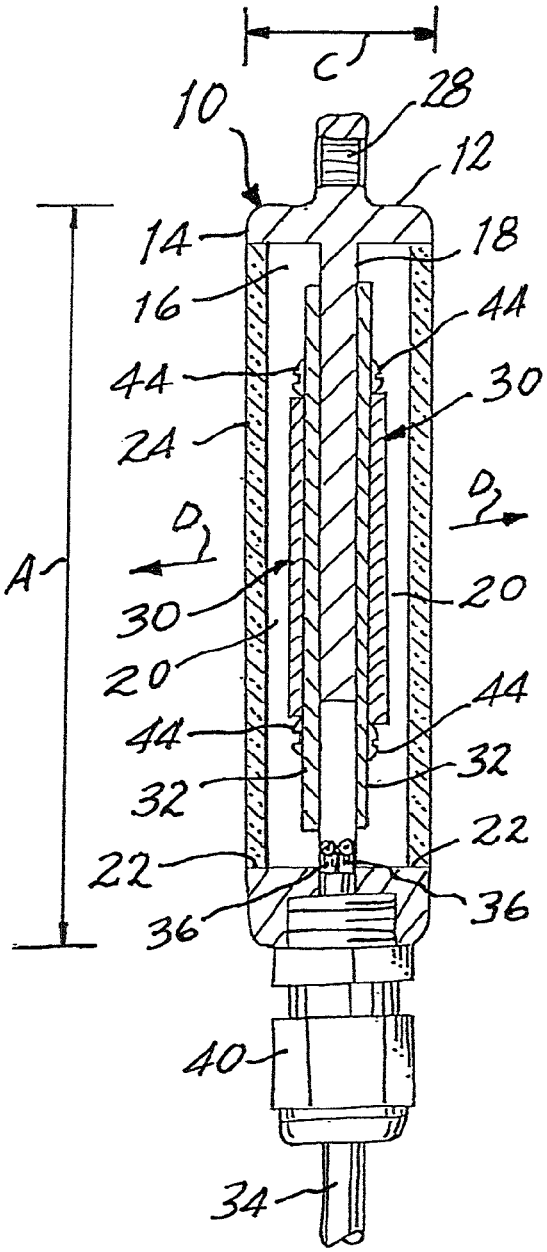

MULTI-DIRECTIONAL UNDERWATER LIGHTING

The present invention relates generally to underwater lighting and pertains, more specifically, to multi-directional underwater lighting having increased intensity and greater effectiveness over a longer range.

Underwater lighting has long been in use, primarily for decorative purposes and for illuminating sites where lighting is employed underwater largely for scientific, commercial, safety or aesthetic purposes such as, for example, in studying and monitoring certain underwater sites, in marking and lighting docking and mooring points, and in illuminating swimming areas and swimming pools. One quite popular use for underwater lighting, both in connection with commercial and sporting operations, is for attracting fish.

Conventional underwater lighting has suffered from a lack of range, requiring excessive bulk in order to provide a desired intensity. Moreover, the illumination made available will decrease over time due to natural fouling, requiring frequent periodic cleaning to maintain effective illumination. In addition, increased lighting intensity has required an increase in power made available to each lighting unit, resulting in the requirement for elaborate power distribution networks.

The present invention provides unique and highly effective underwater lighting that avoids the above-outlined drawbacks. As such, the present invention attains several objects and advantages, some of which are summarized as follows: Provides multi-directional, high-intensity underwater lighting for increased effectiveness in submerged settings; utilizes cooling available by virtue of immersion to enable increased lighting intensity; allows effective employment of light emitting diodes (LEDs) in underwater venues for increased lighting intensity with reduced power requirements; provides a compact and lightweight lighting source for effective underwater use; resists fouling by marine organisms for effective long-term underwater use with reduced cleaning and maintenance requirements; provides a relatively simple and economical construction for practical widespread use; attains an increased range of effectiveness in multi-directional underwater illumination while reducing bulk and power requirements; provides a rugged construction for reliable operation over an extended service life.

The above objects and advantages, as well as further objects and advantages, are attained by the present invention which may be described briefly as underwater lighting apparatus for being immersed in a body of water to be surrounded by the body of water and to illuminate a site juxtaposed with the underwater lighting apparatus during a lighting cycle, the apparatus comprising: a housing constructed of a heat-conductive material; a chamber within the housing; an LED array affixed to the housing, within the chamber so as to conduct heat from the LED array directly to the housing; and a lens member affixed to the housing and sealing the chamber against the body of water, the lens member being in juxtaposition with the LED array for passing light emitted from the LED array to the lens member; whereby heat generated by the LED array during the lighting cycle will be conducted to the housing and dissipated by the housing to the surrounding body of water.

In addition, the present invention provides A method for providing underwater lighting to illuminate a site within a body of water during a lighting cycle, the method comprising: immersing within the body of water, a housing constructed of a heat-conductive material; providing a chamber within the housing; affixing an LED array to the housing, within the chamber, so as to conduct heat directly from the LED array to the housing; and affixing a lens member to the housing with the lens member sealing the chamber against the body of water, and juxtaposed with the LED array for passing light emitted from the LED array through the lens member and into the surrounding body of water; whereby heat generated by the LED array during the lighting cycle will be conducted to the housing and dissipated by the housing to the surrounding body of water.

The present invention will be understood more fully, while still further objects and advantages will become apparent, in the following detailed description of preferred embodiments of the invention illustrated in the accompanying drawing, in which:

FIG. 1 is a partially diagrammatic, pictorial view, partially broken away to show internal details, of an underwater lighting apparatus constructed in accordance with the present invention;

FIG. 2 is a partially diagrammatic enlarged cross-sectional view taken along line 2-2 of FIG. 1;

Figure 3:
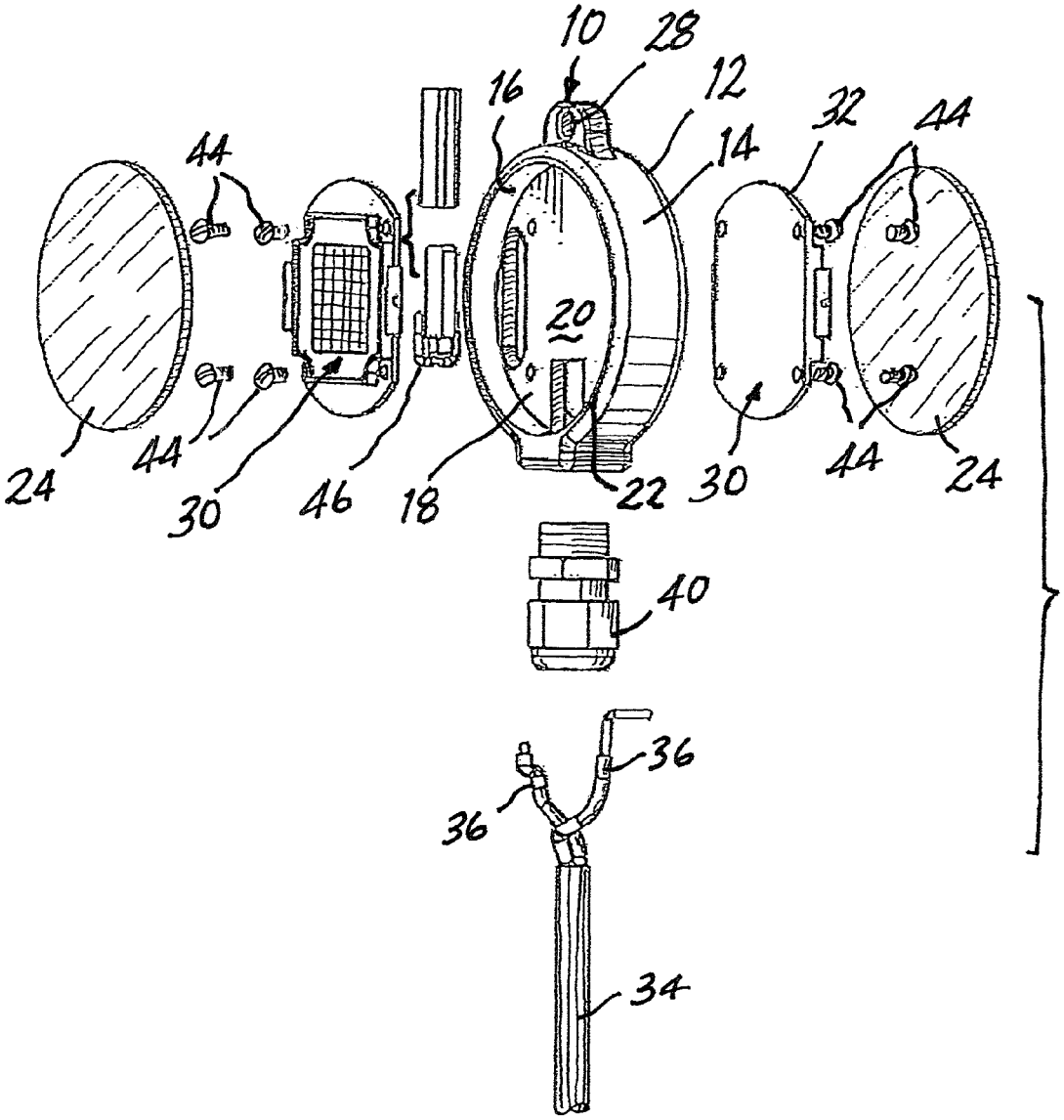
FIG. 3 is an exploded pictorial view of the apparatus.

Referring now to the drawing, and especially to FIGS. 1 through 3 thereof, an underwater lighting apparatus constructed in accordance with the present invention is shown at 10 and is seen to include a housing 12 having a peripheral rim 14 establishing an inner chamber 16. A generally centrally located web 18 extends radially across the chamber 16, spanning the chamber 16 and dividing the chamber 16 into axially opposite compartments 20, each compartment 20 having an opening 22 such that the openings 22 face in axially opposite directions. A lens member in the form of a transparent lens 24 is affixed to the rim 14 and seals each opening 22, closing each compartment 20 in a watertight manner. An eye 28 is integral with rim 14 to facilitate suspension and manipulation of lighting apparatus 10 during use.

A pair of arrays of light emitting diodes (LED arrays) are shown at 30 and are seen to be placed, one of the two LED arrays 30 in each compartment 20, with each LED array 30 having a base 32 affixed to web 18 of housing 12 and located in a compact axially back-to-back arrangement, so as to emit light through a corresponding lens 24 such that light is directed in opposite axial directions D. The compact arrangement enables apparatus 10 to have relatively diminutive dimensions, thereby reducing bulk while providing an extensive field of intense light. Exemplary dimensions include a length A and a width B, each of about three inches, and an axial thickness C of about three-quarters of an inch. An electrical power cable 34 having leads 36 is secured to housing 12 by means of a watertight gland 40 threaded into rim 14 of housing 12. Leads 36 are connected to LED arrays 30 for supplying power to illuminate the LED arrays 30.

Housing 12 is constructed of a heat-conductive material, the preferred material being aluminum, preferably anodized, which is highly heat conductive and which resists corrosion and fouling by marine organisms. Web 18 is integral with rim 14, the rim 14 and the web 18 preferably being formed in a unitary construction. The base 32 of each LED array 30 is affixed to web 18, as by bolts 44, with each base 32 contiguous with and in such intimate contact with web 18 that heat generated by each LED array 30 during an underwater lighting cycle is conducted directly from each LED array 30 to web 18 and through web 18 and rim 14 of housing 12 to be dissipated into the surrounding water. Heat transfer from LED arrays 30 to web 18 may be optimized through the use of thermal grease or thermal pads at the juncture of each base 32 and web 18. Thus, the housing 12 serves as an effective heat sink that allows efficient operation of the LED arrays 30 for exemplary high-intensity lighting when immersed at a site to be illuminated. A thermal switch 46 is interposed between power cable 34 and the LED arrays 30 and is affixed to web 18 to detect temperature at the web 18 and to interrupt the supply of power to the LED arrays 30 upon detecting excessively high temperature, thereby protecting the LED arrays 30 against failure due to a possible build-up of excessive heat.

Figure 4:
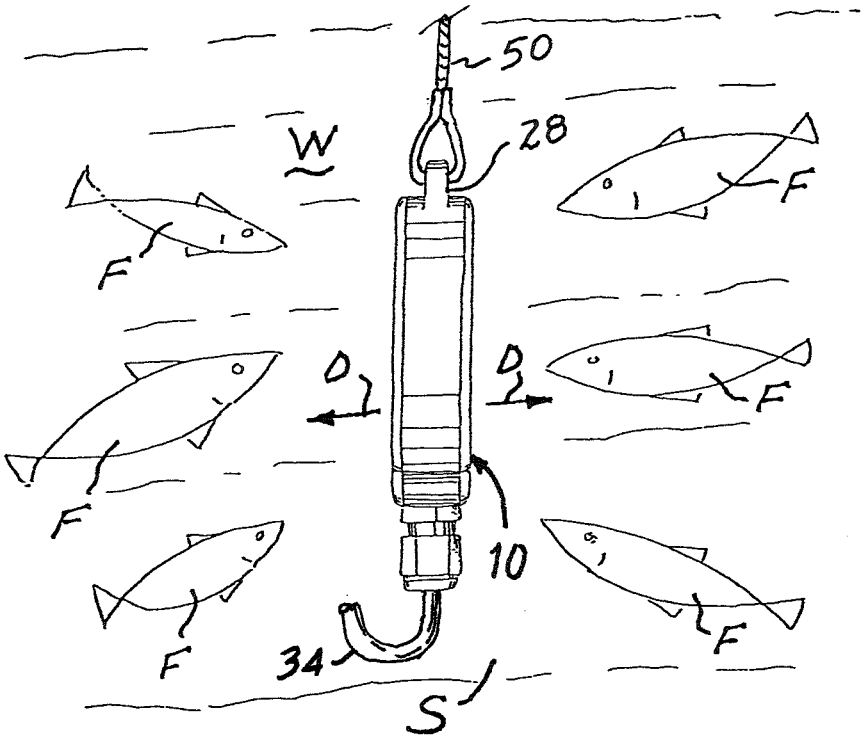
FIG. 4 is a pictorial view, not to scale, showing the apparatus immersed in a body of water during a typical use.
Figure 5:
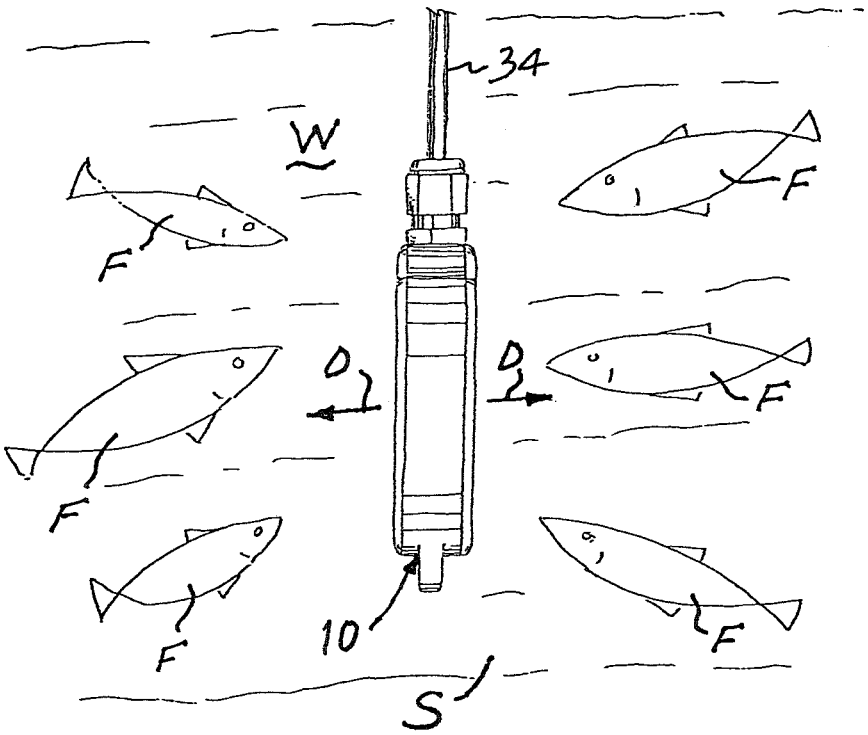
FIG. 5 is a pictorial view similar to FIG. 4 and showing an alternate arrangement.

A typical use of apparatus 10 is illustrated in FIG. 4 wherein lighting apparatus 10 is seen submerged in a body of water W to attract fish F at a site S by virtue of light emitted in directions D. Here, lighting apparatus 10 is suspended and manipulated by a line 50 coupled to eye 28. The high-intensity lighting made available by the very compact apparatus 10 provides an unobtrusive source of very bright light throughout an extensive surrounding field, rendering lighting apparatus 10 highly effective in accomplishing the described goal. Further, the high-intensity lighting provided by LED arrays 30 militates against fouling of the submerged lighting apparatus 10 by marine organisms. Alternately, as seen in FIG. 5, lighting apparatus 10 may be suspended in water W and manipulated at site S directly by power cable 34.

It will be seen that the present invention attains all of the objects and advantages summarized above, namely: Provides multi-directional, high-intensity underwater lighting for increased effectiveness in submerged settings; utilizes cooling available by virtue of immersion to enable increased lighting intensity; allows effective employment of light emitting diodes (LEDs) in underwater venues for increased lighting intensity with reduced power requirements; provides a compact and lightweight lighting source for effective underwater use; resists fouling by marine organisms for effective long-term underwater use with reduced cleaning and maintenance requirements; provides a relatively simple and economical construction for practical widespread use; attains an increased range of effectiveness in multi-directional underwater illumination while reducing bulk and power requirements; provides a rugged construction for reliable operation over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. Underwater lighting apparatus for being immersed in a body of water to be surrounded by the body of water and to illuminate a site juxtaposed with the underwater lighting apparatus during a lighting cycle, the apparatus comprising:

a housing constructed of a heat-conductive material;

a chamber within the housing;

at least two LED arrays, each affixed to the housing within the chamber so as to conduct heat from the LED arrays directly to the housing; and a corresponding lens member affixed to the housing in juxtaposition with each LED array of the at least two LED arrays for sealing the chamber against the body of water and for passing light emitted from each LED array to the corresponding lens member, with the LED arrays and corresponding lens members located so as to direct light in different directions;

whereby heat generated by the LED arrays during the lighting cycle will be conducted to the housing and dissipated by the housing to the surrounding body of water.

2. The apparatus of claim 1 wherein the at least two LED arrays, and the corresponding lens members, are located axially opposite one-another.

3. The apparatus of claim 1 wherein the housing includes a peripheral rim, and a web integral with the rim and spanning the chamber, the LED arrays being affixed to the web.

4. The apparatus of claim 3 wherein the web divides the chamber into first and second compartments located axially opposite one-another, an LED array is affixed to the web in each compartment, and a lens member is juxtaposed with each LED array for passing light emitted from each LED array to a corresponding lens member for being directed in axially opposite directions.

5. The apparatus of claim 1 including a watertight gland affixed to the housing for securing a power cable to the housing to furnish power to the LED arrays.

6. A method for providing underwater lighting to illuminate a site within a body of water during a lighting cycle, the method comprising:

immersing within the body of water, a housing constructed of a heat-conductive material;

providing a chamber within the housing;

affixing at least two LED arrays to the housing within the chamber, so as to conduct heat directly from the LED arrays to the housing;

affixing a corresponding lens member to the housing in juxtaposition with each LED array of the two LED arrays for sealing the chamber against the body of water, and for passing light emitted from each LED array through the corresponding lens member and into the surrounding body of water; and locating each LED array and corresponding lens member for directing light generated by the LED arrays in different directions;

whereby heat generated by the LED arrays during the lighting cycle will be conducted to the housing and dissipated by the housing to the surrounding body of water.

7. The method of claim 6 including locating the at least two LED arrays, and the corresponding lens members, axially opposite one-another.

8. The method of claim 6 including dividing the chamber into first and second compartments located axially opposite one-another, affixing an LED array in each compartment, and juxtaposing a lens member with each LED array for passing light emitted from each LED array to a corresponding lens member for being directed in axially opposite directions.

* * * * *